US005641138A

United States Patent [19]

Cronk et al.

[11] Patent Number: 5,641,138

[45] Date of Patent: Jun. 24, 1997

[54] TRASH BAG STAND

[75] Inventors: Leon Cronk, Grand Ledge; Quentin Alverson, Dewitt, both of Mich.

[73] Assignee: The ServiceMaster Company, Downers Grove, Ill.

[21] Appl. No.: 426,824

[22] Filed: Apr. 21, 1995

[51] Int. Cl.[6] ..... A63B 55/04

[52] U.S. Cl. ..... 248/99; 248/95; 248/101; 242/597.8

[58] Field of Search ..... 242/597.8; 248/99, 248/95, 101

[56] References Cited

U.S. PATENT DOCUMENTS

| | | | |
|---|---|---|---|
| 1,456,175 | 5/1923 | Borlase | 248/99 X |
| 2,191,849 | 2/1940 | Debrie | 242/597.8 X |
| 3,866,872 | 2/1975 | Burgess | 248/101 X |
| 3,893,649 | 7/1975 | Cornell et al. | 248/99 |
| 4,899,967 | 2/1990 | Johnson | 248/99 X |
| 5,263,672 | 11/1993 | He | 248/99 X |
| 5,275,490 | 1/1994 | Loebbert | 248/99 X |
| 5,377,941 | 1/1995 | Har et al. | 248/101 |
| 5,456,431 | 10/1995 | Ilnisky | 248/99 X |
| 5,478,152 | 12/1995 | Bogle | 248/99 X |

*Primary Examiner*—Wynn E. Wood

*Attorney, Agent, or Firm*—Banner & Witcoff, Ltd.

[57] ABSTRACT

A trash bag stand comprises a lip ring, a stand fastener, a bag securing mechanism, a drop and a bag dispenser. The bags are disposable and each bag is assumed to have, as typical, a body with a length and a lip defining the opening of the bag into the bag body, the lip having a circumference. The lip ring has a circumference approximately equal to the bag lip circumference and has a length perpendicular to the plane of its circumference substantially shorter than the length of the bag. The stand fastener fastens the ring to substantially any desired support structure. The bag securing mechanism preferably takes the form of a securing ring for securing the bag lip to the lip ring, and is hingedly fastened to the lip ring to remain with the lip ring and also be movable between a position in which the securing means secures the bag lip to the ring, and a position in which the securing means is sufficiently distant from the ring to provide for placement of the bag lip on the ring. Below the ring, the stand defines open access to a trash bag placed on the ring, for removal of the bag when filled from the stand without lifting of the filled bag over the ring. The drop extends from the ring a length substantially equal to the length of the bag, to an end, and the bag dispenser is located on the end of the ring. The bag dispenser receives a quantity of bags for serial dispensing onto the ring.

8 Claims, 2 Drawing Sheets

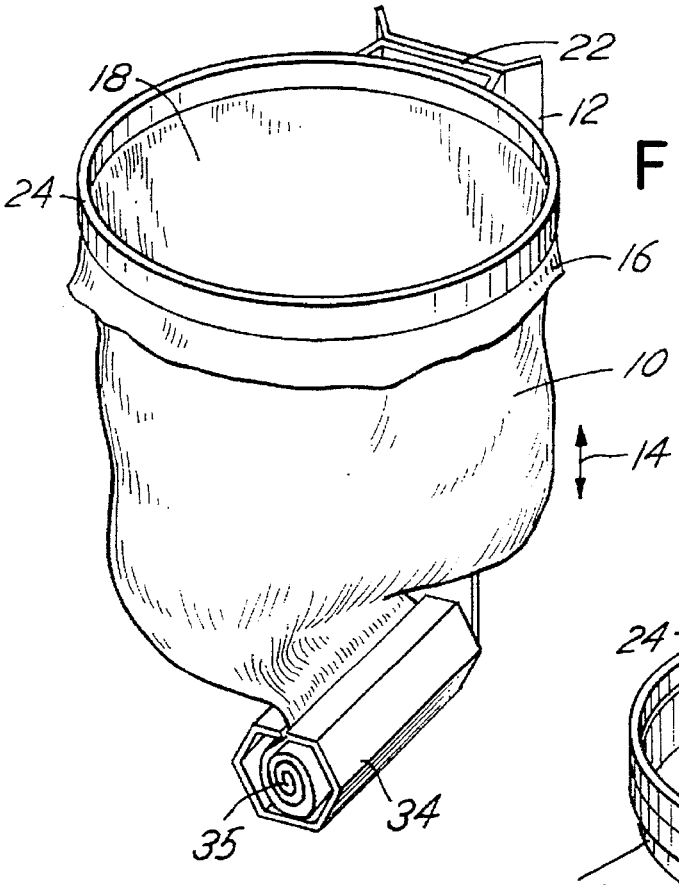
FIG.1
FIG.2
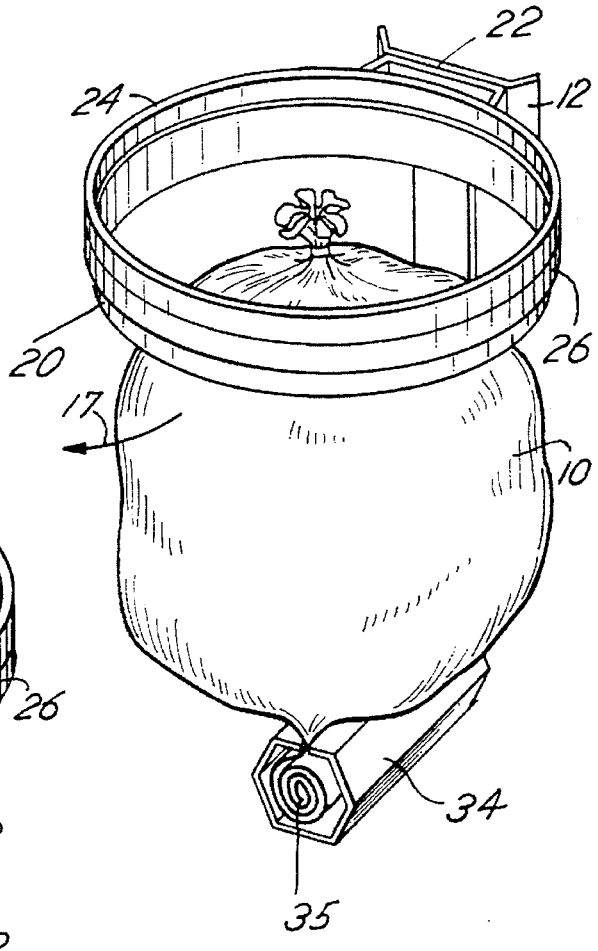
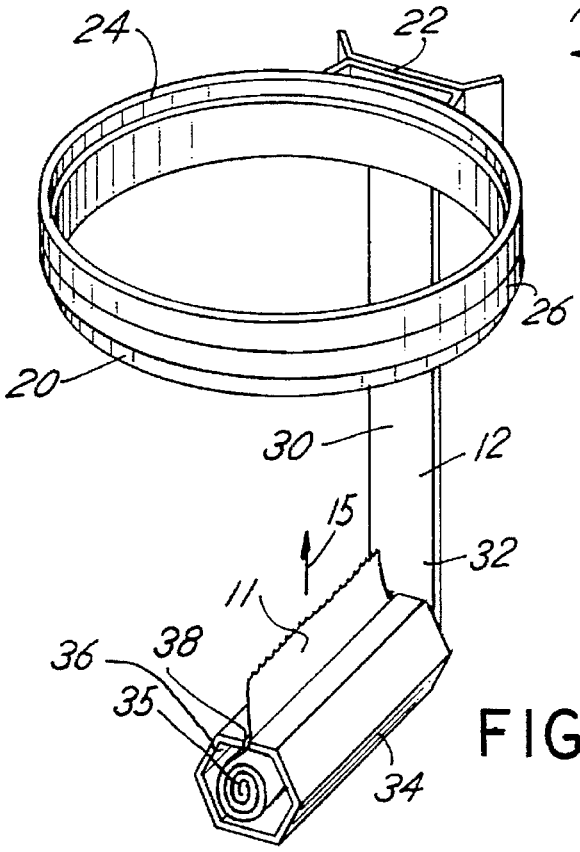
FIG.3

FIG. 4
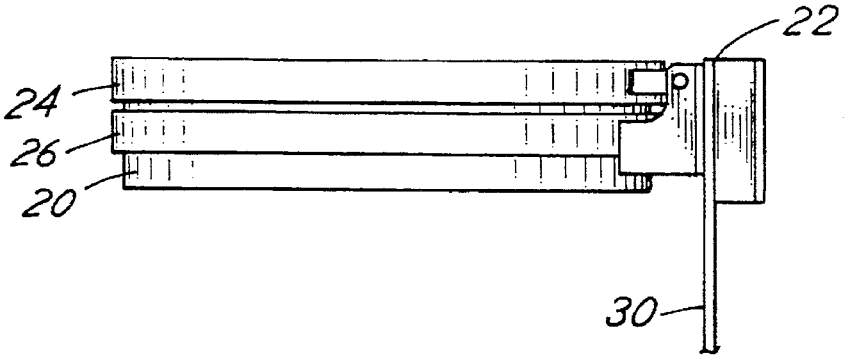
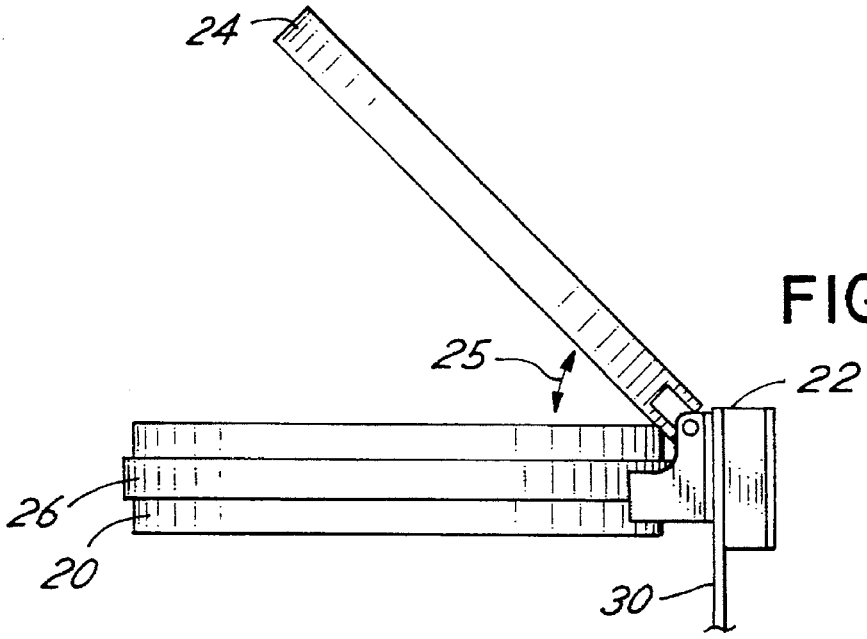
FIG. 5
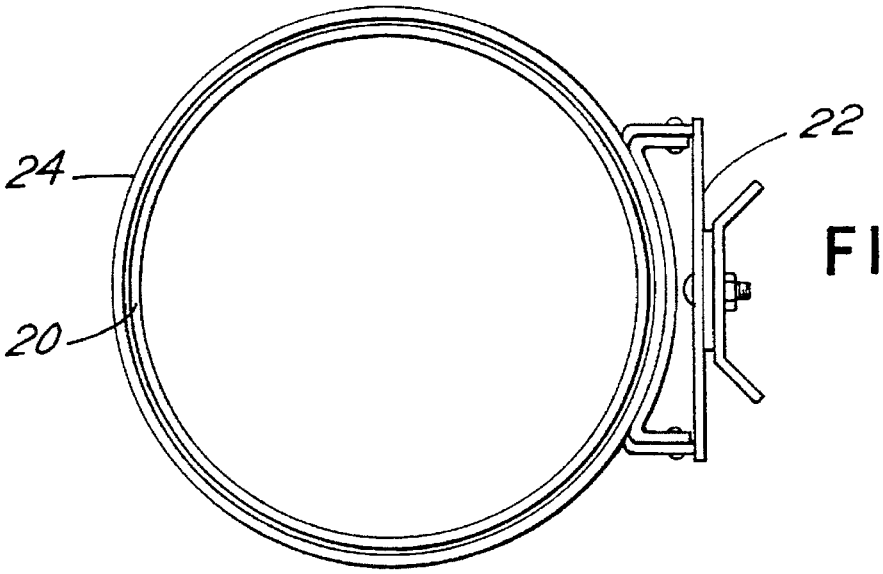
FIG. 6

TRASH BAG STAND

BACKGROUND OF THE INVENTION

The invention relates to trash receptacles, and more particularly, to the methods and mechanisms by which disposable trash bags are placed, held and removed for disposal.

Over the last many years, plastic has been adapted to create disposable plastic trash bags. These bags are now found in common use in homes, businesses and industry. Typically, disposable plastic trash bags (hereafter simply "the bags") are packaged in rolls or in folded quantities in cardboard shipping cartons or boxes and shipped, bought, and sold in that condition. The shipping cartons are opened and the bags removed one at a time. When packaged in rolls, the bags must be separated one from another along manufactured sections as they are removed, one at a time, from the cartons.

Commonly, the bags are placed in trash cans, with the lips of the bags spread over the rims of the cans. Nothing is used to hold the bags to the cans, except the simple repose of the bag, or sometimes a lid placed on the top of the can.

When the bags are filled, the filled bags are lifted from the cans, tied or otherwise sealed shut, and put out for disposal. New bags are retrieved from storage areas, from their shipping cartons, and put in the emptied cans.

Disposable plastic trash bags have numerous advantages of sanitation, ease of handling and like. At the same time, however, they commonly require that the filled bags, which become heavy, be lifted manually and vertically to clear the tops of the trash cans, which requires that the heavy bags be lifted to heights of four to five feet, often at arms lengths from the body. Also, even when users place the shipping cartons of the bags near the cans, disposable plastic trash bags require that the users retrieve new bags from storage locations separate from the cans, which is often an inconvenience. Further, no convenient means is typically available to secure the bags to the cans, and the bags often collapse inside the cans, resulting in trash getting lodged between the bag and can, or atop but not in the bag. While at least one commercial user clips the bags to the cans, the clips become lost and are inconvenient to remove, save and then replace.

SUMMARY OF THE INVENTION

A primary object of the invention of this description is to overcome the problems of past usages of disposable plastic trash bags, and make such bags as convenient as possible to use.

More specifically, an object of the invention is to eliminate any need to lift heavy, filled bags from trash cans.

Another object is to provide a highly convenient means for securing disposable plastic trash bags in position to be filled.

A further object of the invention is to provide a highly convenient means for getting bags from their rolls into position to be used.

These and other objects, features and advantages are accomplished in the invention and its preferred embodiment, described in detail hereafter. In summary, however, the invention takes the form of a trash bag stand comprising a lip ring, a fastening means and bag securing means. Each bag is assumed to have, as typical, a body with a length and a lip defining the opening of the bag into the bag body, the lip having a circumference. The lip ring has a circumference approximately equal to the bag lip circumference and has a length perpendicular to the plane of the circumference substantially shorter than the length of the bag. The fastening means is means for fastening the ring to substantially any desired support structure. The bag securing means is for securing the bag lip to the ring, and it is movably fastened to the ring to remain with the ring and also be movable between a position in which the securing means secures the bag lip to the ring, and a position in which the securing means is sufficiently distant from the ring to provide for placement of the bag lip on the ring. Below the ring, the stand defines open access to a trash bag placed on the ring, for removal of the bag when filled from the stand without lifting of the filled bag over the ring. The stand also comprises a drop extending from the ring a length substantially equal to the length of the bag, to an end, and a bag dispenser on the end of the ring, the bag dispenser receiving a quantity of bags for serial dispensing onto the ring.

BRIEF DESCRIPTION OF THE DRAWING

Hereafter, the preferred embodiment of the preferred embodiment of the invention will be described in relation to the accompanying drawing. The drawing consists of six figures, and each is briefly described as follows:

FIG. 1 is a perspective view of the preferred embodiment of the invention with a bag in place to take trash;

FIG. 2 is a perspective view of the preferred embodiment with the bag tied off and being removed;

FIG. 3 is a perspective view of the preferred embodiment with a next bag being pulled into place;

FIG. 4 is a side elevation view of the top portion of the preferred embodiment;

FIG. 5 is a side elevation view of the top portion of the preferred embodiment, similar to FIG. 5, with the clamp ring lifted; and FIG. 6 is a top plan view of the preferred embodiment.

DETAILED DESCRIPTION OF THE PREFERRED EMBODIMENT

Referring to FIGS. 1–6, the preferred trash bag stand 12 is a stand for disposable plastic trash bags such as bag 10.

Before describing the stand 12, the typical trash bag must be defined. As shown in FIG. 1, the typical trash bag 10 has a length in a direction 14 and a lip 16 defining the opening into the interior 18 of the bag. The bag is formed of two planar rectangles of plastic joined along the edges, and the lip when opened defines a circle with a circumference equal to twice the width of the sheets forming the bag.

A lip ring 20 of the stand 10 has a circumference approximately equal to that of the bag lip. The lip ring 20 is formed of steel or the like, and is preferably circular. In use of the stand 12, the lip ring 20 lies in horizontal planes and is circular about a vertical central axis. The lip ring 20 has a length perpendicular to the planes of its circumference, i.e., in the vertical in the position of use of the stand, or in direction 14, substantially shorter than the length of the bag, on the order of two to three inches.

A bracket 22 is fixed to the lip ring 20 and provides for fastening of the lip ring 20 to substantially any desired support structure, such as a work bench or wall or the like.

A bag securing means provides for securing the bag lip to the lip ring 20, as shown in FIG. 1, and as preferred, the bag securing means takes the form of a rigid securing ring 24. As will be described in more detail, the bag securing ring 24 is movably hingedly fastened to the lip ring 20 to remain with the lip ring 20 and also to be movable between a position in which the securing means secures the bag lip to the lip ring 20, and a position in which the securing means is sufficiently distant from the lip ring 20 to provide for placement of the bag lip 16 on the lip ring 20. The lip ring and the bag securing ring are hinged together during all movable positions. The rings can be detached for repairing or replacing.

Below the lip ring 20, the stand 10 provides open access to a trash bag placed on the ring, for removal of the bag when filled from the stand in the direction 17, without lifting of the filled bag over the ring, as shown in FIG. 2.

The securing ring 24 in cooperation with the lip ring 20 secures the bag lip 16 to the lip ring 20 by friction. The securing ring 24 has a circumference greater than the circumference of the lip ring 20, and substantially equal to the circumference of the lip ring 20 with a bag lip 16 placed over the lip ring 20. The lip ring 20 includes a stop ring 26 on the lip ring 20 for abutting, and thereby stopping the movement of and properly locating, the securing ring 24 in the position in which the securing ring holds the bag to the lip ring, as in FIG. 1. The securing ring 24 fits around the lip ring 20, rests on the stop ring 26, and holds the bag lip to the lip ring 20 with friction between the bag and lip ring, and also between the bag and securing ring and the bag and stop ring.

The securing ring 24 is hinged to the bracket 22 and thereby the stand 10 and lip ring 20, for movement to and from a position as in FIGS. 1, 2, 3, 5 and 6 in which the securing ring 24 surrounds at least a portion of the lip ring 20. As shown by the partial motion depicted in FIG. 4, the securing ring 24 is movable and pivotable in an arc 25 from the normal position of FIGS. 1, 2, 3, 5 and 6 to a position in which the securing ring 24 is removed from the lip ring 20 and out of the way of placement of bags on the lip ring 20. As preferred, the securing ring 24 is movable and pivotable to a position in which the securing ring 24 remains upright and out of the way, without needing to be held there.

Referring to FIG. 3, a drop 30 extends from the rings 20, 24, 26 a length substantially equal to the length of the bag, to an end 32. The drop is also formed of steel or the like.

A bag dispenser 34 is located on the end 32 of the drop 30. As shown in all FIGS. 1–3, the bag dispenser 34 receives a quantity of bags 35 for serial dispensing onto the ring. As may be seen, the bag dispenser 34 defines an interior 36 for receiving and storing the bags 35 and a bag slot 38 from the interior 36 facing toward the rings for passage of bags from the interior through the slot 38 to the lip ring 20.

As may now be understood, the stand is used as follows. First, the stand is fastened to a work bench, wall or the like by use of the mounting bracket 22. An associated bracket may receive the mounting bracket 22, for removable mounting of the stand 10, or the stand may be more permanently placed on the desired support. With the stand 10 in place, a roll of disposable trash bags 35 is placed in the bag dispenser 34 and the first bag 10 threaded through the bag slot 38. The securing ring 24 is then pulled back as explained above and shown in FIG. 5. Pulling on the first bag 10 in direction 15, FIG. 3, rolls the bag roll 35, allowing the first bag 10 to extend upward to the lip ring 20. When the lip 16 of the first bag 10 reaches the lip ring 20, the bag lip 16 may be placed from inside the lip ring 20 through and over the lip ring 20. With the lip 16 located as in FIG. 1, the securing ring 24 is lowered over the lip ring 20 against the stop ring 26, and holds the bag lip 16 and thereby the bag 10 in position to be used.

When the bag 10 is full, the securing ring 24 is again lifted and the bag 10 removed from below the lip ring 20, as in FIG. 2. The bag 10 need not be raised through the lip ring and may instead be removed from below the lip ring 20 in direction 17. Preferably, before removal, the filled bag 10 is separated from the next bag 11, or alternatively, the filled bag 10 may be separated from the next bag 11 after removal, or the bags 10, 11 may be separated when the first bag 10 is first positioned on the lip ring 20.

After removal of the first bag 10, the next bag 11 is pulled from the dispenser and placed as was the first. Succeeding bags are placed, used, and removed in the same manner in series The invention and its preferred embodiment are now described in such full, clear, concise and exact terms as to enable a person of ordinary skill in the art to make and use the same. To eliminate confusion and particularly point out and distinctly claim the subject matter regarded as invention, the following claims conclude this description.

What is claimed is:

1. A trash bag stand for disposable trash bags, the disposable bags each having a bag length and a bag lip defining the opening of the bag, the bag lip having a circumference, the stand comprising:

a lip ring for the bag lip, the lip ring having a circumference approximately equal to the bag lip circumference and the lip ring having a cylindrical length perpendicular to the plane of the circumference of the lip ring substantially shorter than the bag length;

means for fastening the lip ring to substantially any desired support structure; and a rigid bag securing means for securing the bag lip to the lip ring, the rigid bag securing means movably fastened to the lip ring and movable between a position in which the securing means secures the bag lip to the lip ring, and a position in which the securing means is sufficiently distant from the lip ring to provide for placement of the bag lip on the lip ring, the rigid bag securing means further hingedly remaining with the lip ring in all movable positions;

the stand defining below the ring open access to a trash bag placed on the lip ring, for removal of the bag when filled from the stand without lifting of the filled bag of the lip ring.

2. A disposable trash bag stand as in claim 1 in which the bag securing means comprises a securing ring, the securing ring in co-operation with the lip ring securing the bag lip to the lip ring by friction.

3. A disposable trash bag stand as in claim 1 in which the bag securing means comprises a securing ring having a circumference greater than the circumference of the lip ring, and substantially equal to the circumference of the lip ring with a bag lip placed thereover, the securing ring fitting around the lip ring and holding the bag lip to the lip ring with friction between the bag and lip ring, and also between the bag and securing ring.

4. A disposable trash bag stand as in claim 1 in which the bag securing means comprises a securing ring having a circumference greater than the circumference of the lip ring, and substantially equal to the circumference of the lip ring with a bag lip placed thereover, the securing ring fitting around the lip ring and holding the bag lip to the lip ring with friction between the bag and lip ring, and also between the bag and securing ring, the securing ring hinged to the stand for movement between a position in which the securing ring surrounds at least a portion of the lip ring, and a position in which the securing ring is removed from the lip ring.

5. A disposable trash bag stand as in claim 4, the lip ring including a stop on the lip ring for abutting, and thereby stopping the movement of and properly locating, the securing ring in the position in which the securing ring holds the bag to the lip ring.

6. A trash bag stand for disposable trash bags, the disposable bags each having a bag length and a bag lip defining the opening of the bag, the bag lip having a circumference, the stand comprising:

a lip ring for the bag lip, the lip ring having a circumference approximately equal to the bag lip circumference and the lip ring having a cylindrical length perpendicular to the plane of the circumference of the lip ring substantially shorter than, the bag length;

means for fastening the lip ring to substantially any desired support structure; and a rigid bag securing means for securing the bag lip to the lip ring, the rigid bag securing means movably fastened to the lip ring and movable between a position in which the securing means secures the bag lip to the lip ring, and a position in which the securing means is sufficiently distant from the lip ring to provide for placement of the bag lip on the lip ring, the rigid bag securing means further hingedly remaining with the lip ring in all movable positions;

a drop extending from the lip ring length substantially equal to the bag length; and a bag dispenser on an end of the drop, the bag dispenser receiving a quantity of bags for serial dispensing onto the lip ring; the stand defining below the ring open access to a trash bag placed on the lip ring, for removal of the bag when filled from the stand without lifting of the filled bag of the lip ring.

7. A disposable trash bag stand as in claim 6, the bag dispenser defining an interior for receiving and storing the bags and a bag slot from the interior facing toward the lip ring for passage of bags from the interior through the slot to the ring.

8. A disposable trash bag stand as in claim 7, the ring being circular about a substantially vertical central axis, and the drop extending vertically downward from the ring, in positions of usage of the stand.

* * * * *